US006412143B1

(12) United States Patent
Chen

(10) Patent No.: US 6,412,143 B1
(45) Date of Patent: Jul. 2, 2002

(54) STRUCTURE OF MATERIAL FOR FORMING A STOP AT AN END OF LASHING STRING

(76) Inventor: Cheng-Lu Chen, No. 11, Luo-Nung Rd., Sha-Lun Li Tien-Chung Township, Chang Hua Hsien (TW)

( * ) Notice: Subject to any disclaimer, the term of this patent is extended or adjusted under 35 U.S.C. 154(b) by 0 days.

(21) Appl. No.: 09/756,051

(22) Filed: Jan. 8, 2001

(51) Int. Cl.[7] ..... A45C 3/04; A45F 5/10

(52) U.S. Cl. ..... 16/114.1; 16/442; 16/428; 16/110.1; 24/713.1; 24/715.4; 24/715.7

(58) Field of Search ..... 16/114.1, 442, 16/428, 110.1; 24/713.1, 715.4, 715.7; 383/14, 15, 16, 21, 22, 23

(56) References Cited

U.S. PATENT DOCUMENTS 574,686 A * 1/1897 Nichols ..... 24/713.1
2,152,349 A * 3/1939 Flood ..... 24/715.4
2,992,768 A * 7/1961 Gatward ..... 229/117.09
3,581,353 A * 6/1971 Sonntag ..... 24/715.4
3,636,594 A * 1/1972 Faivre ..... 119/769
4,510,620 A * 4/1985 Langen et al. ..... 383/14
5,926,924 A * 7/1999 Tsai ..... 16/419
6,119,591 A * 9/2000 Chen ..... 101/35
6,167,599 B1 * 1/2001 Chen ..... 24/712

* cited by examiner

*Primary Examiner*—Chuck Y. Mah
(74) *Attorney, Agent, or Firm*—Harrison & Egbert

(57) ABSTRACT

A material is used to form a stop at the end of a lashing string. The material is made of a plastic material and takes the form of a long strap, which is rolled up and is provided in two long sides with a plurality of ridges and grooves. The ridges and the grooves are alternately arranged to form a plurality of lashing portions, with each being adhered to the end of the lashing string to form the stop serving to prevent the lashing string from slipping out of a string hole of the paper bag and the like.

3 Claims, 7 Drawing Sheets

STRUCTURE OF MATERIAL FOR FORMING A STOP AT AN END OF LASHING STRING

BACKGROUND OF THE INVENTION

1. Field of the Invention

The present invention relates generally to a lashing string, and more particularly to a material for forming a stop at the end of the lashing string.

2. Description of Related Art

As shown in FIGS. 1 and 2, a metal material 01 of the prior art is used to form a knot at the end of a fabric string 02, which is used as the string handles of a shopping bag and the like. The knot is formed at the end of the fabric string 02 by covering the flat material 01 around the end of the fabric string 02 in such a manner that two opposite sides 11 of the material 01 are folded toward each other and then pressed against the outer surface of the fabric string 02. The knot so formed is intended to prevent the detachment of the fabric string 02 from the string hole of the shopping bag and the like.

The prior art metal material 01 described above is defective in design because the metal material 01 has a smooth surface which makes the knot rather susceptible to slipping out of the end of the fabric string 02, and because the process of forming the lump is not cost-effective, and because the rejection rate of the knot is apt to be rather high if the work is not done by an experienced worker. Moreover, the two opposite sides 11 of the fabric material 01 undermine aesthetic effect of the fabric string 02.

BRIEF SUMMARY OF THE INVENTION

The primary objective of the present invention is to provide a stop-forming material which is free of the drawbacks of the prior art metal material described above.

In keeping with the principle of the present invention, the foregoing objective of the present invention is attained by the knot-like stop-forming material, which is formed as a long strap having two corrugated sides opposite to each other. The stop so formed is removably secured in place at the end of a string.

The features and advantages of the present invention will be more readily understood upon a thoughtful deliberation of the following detailed description of preferred embodiments of the present invention with reference to the accompanying drawings.

DETAILED DESCRIPTION OF THE INVENTION

As shown in FIGS. 3–7, a material 03 embodied in the present invention is used to form a stop 40 at the end of a lashing string 04.

Figure 1:
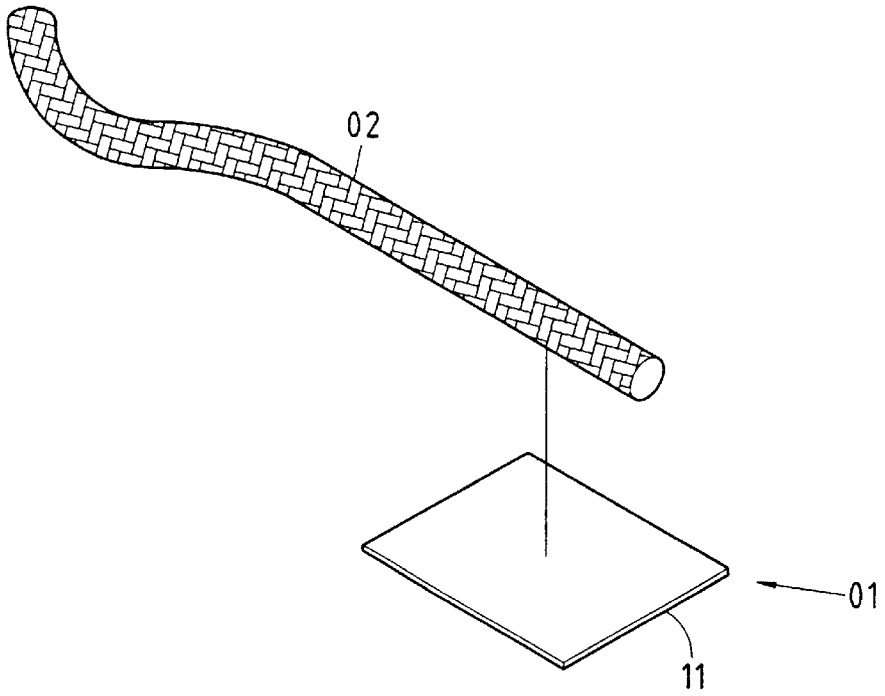
FIG.1 PRIOR ART
FIG. 1 shows a schematic view of the prior art.
Figure 2:
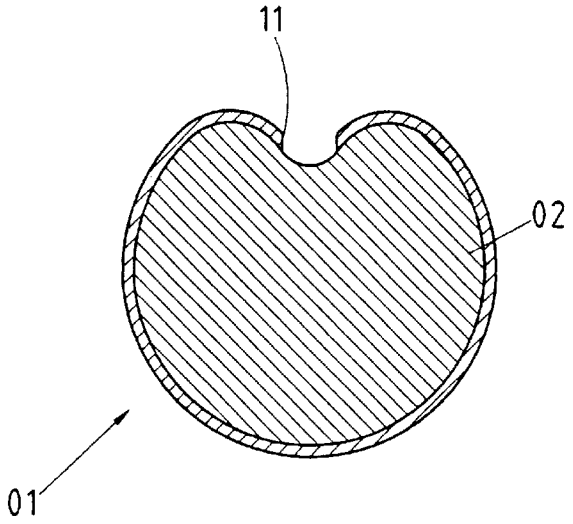
FIG.2 PRIOR ART
FIG. 2 shows a cross-sectional schematic view of the prior art.
Figure 3:
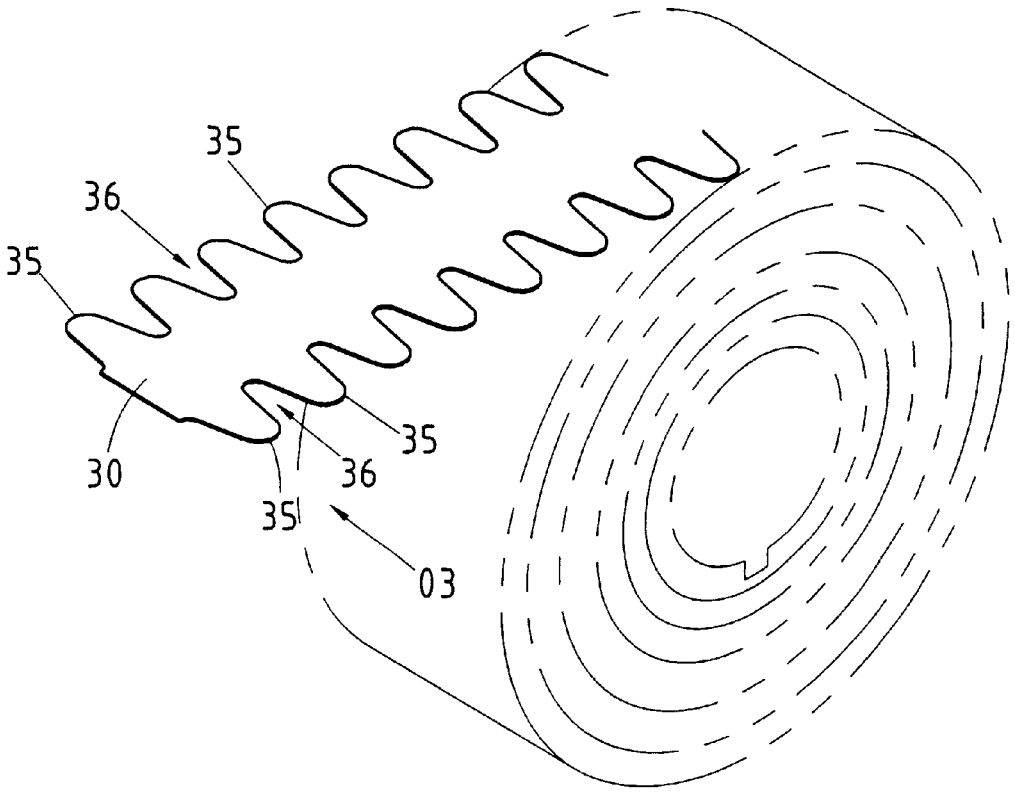
FIG. 3 shows a perspective view of the present invention.
Figure 4:
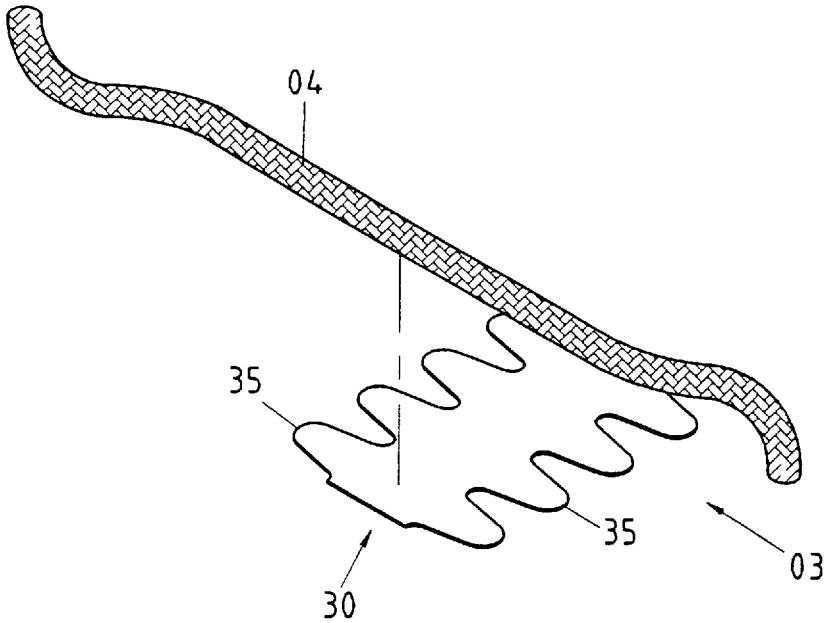
FIG. 4 shows a schematic view of the present invention at work.
Figure 5:
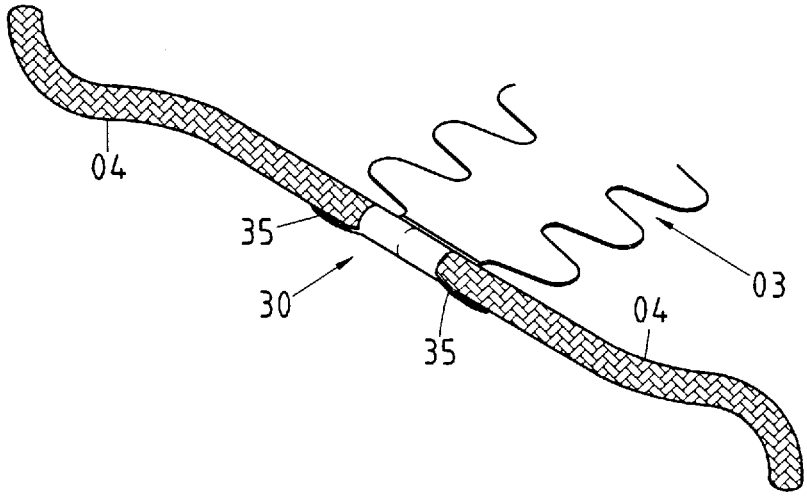
FIG. 5 shows another schematic view of the present invention at work.
Figure 6:
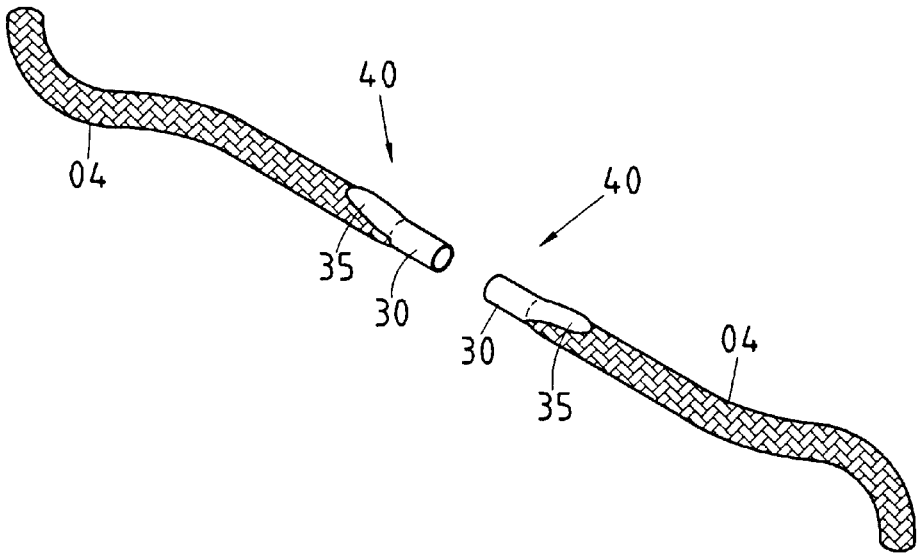
FIG. 6 shows still another schematic view of the present invention at work.
Figure 7:
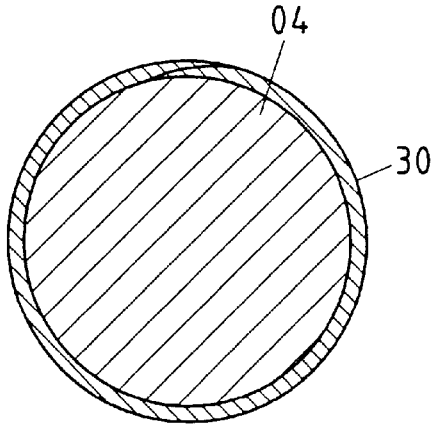
FIG. 7 shows a sectional view of the present invention.
Figure 8:
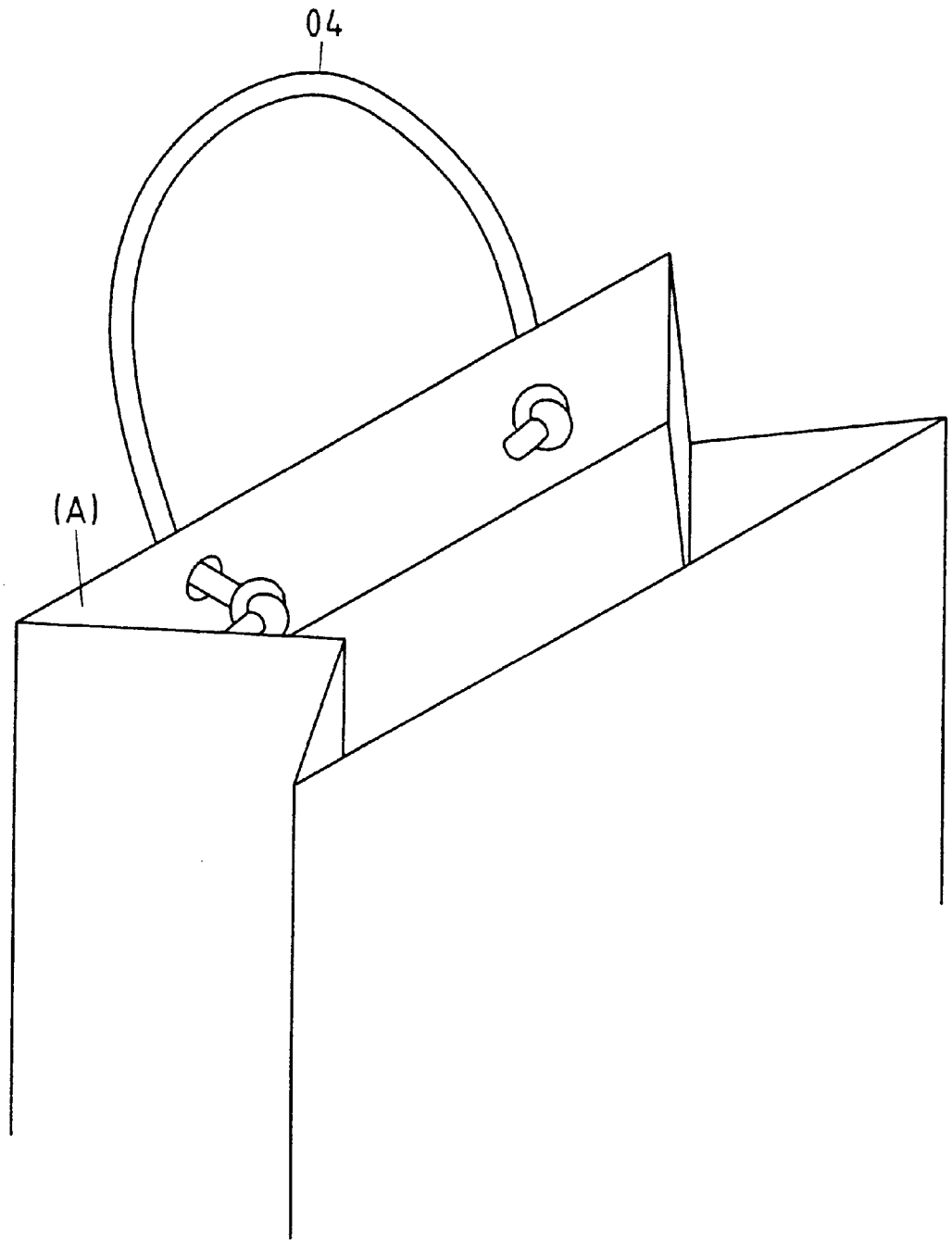
FIGS. 8. and 9 show schematic views of a shopping bag which is provided with the string handles of the present invention.

The material 03 is made of a plastic material. The material 03 takes the form of a long strap, which can be rolled up, as shown in FIG. 3. The material 03 has two long sides which are opposite to each other and are provided with a plurality of ridges 35 and grooves 36. The ridges 35 and the grooves 36 are arranged alternately such that two opposite ridges 35 of the two long sides of the material 03 form a lashing portion 30. In other words, the material 03 of the present invention contains a plurality of lashing portions 30, which are attached by an adhesive to the end of the string 04 to form the stop 40.

Figure 9:
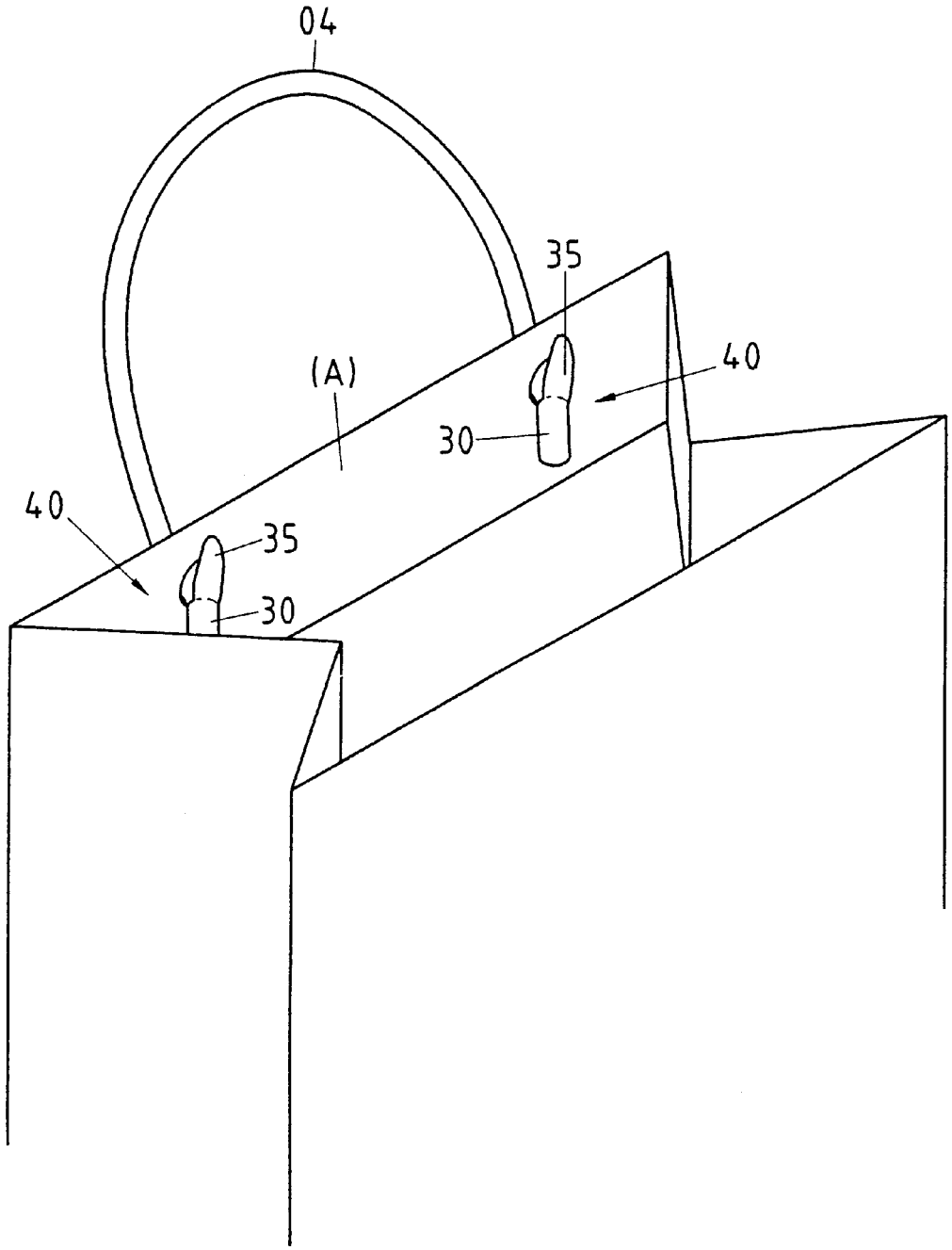

In light of the material 03 of the present invention taking the form of a long strap, the material 03 can be fed into an automatic stop-forming device, so as to streamline the process of forming a stop at the end of the string. Each stop 40 has a ridge 35, which serves to prevent the string 04 from slipping out of the string hole of a paper bag "A", as shown in FIG. 9.

Figure 10:
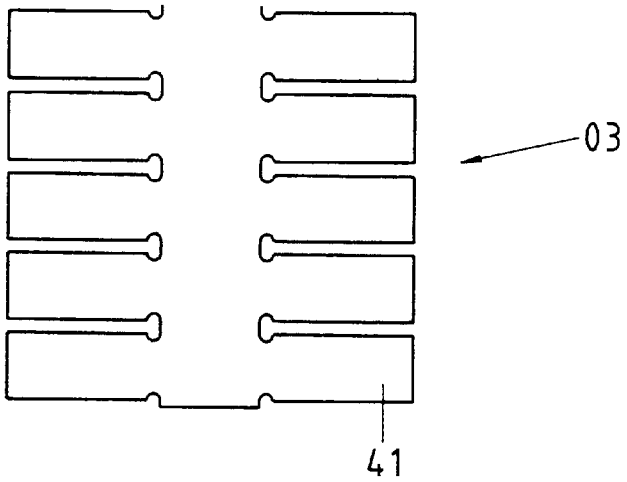
FIG. 10 shows a schematic view of another preferred embodiment of the present invention.
Figure 10:
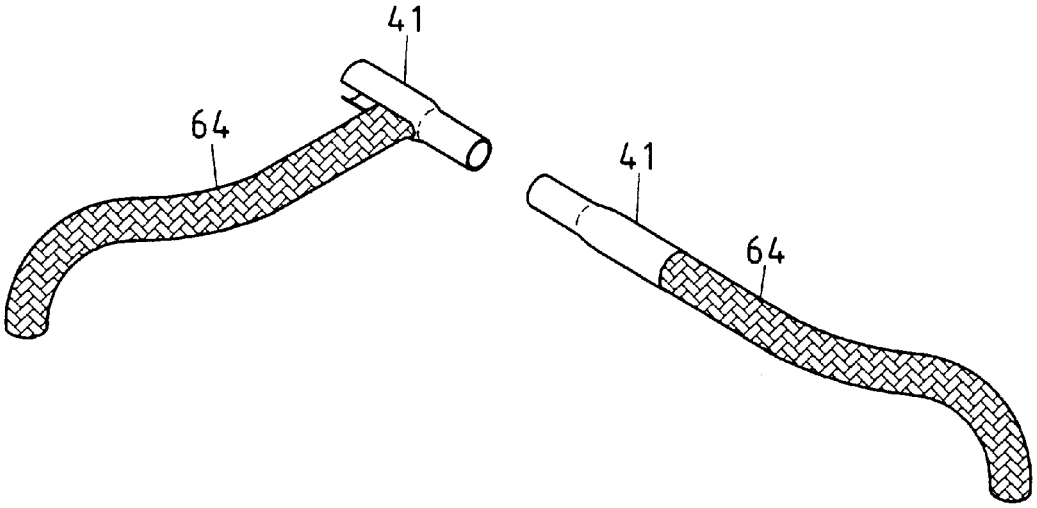

As shown in FIG. 10, the material 03 of another preferred embodiment of the present invention forms a tubular retaining piece 41 along with a string 64.

The embodiments of the present invention described above are to be regarded in all respects as being merely illustrative and not restrictive. Accordingly, the present invention may be embodied in other specific forms without deviating from the spirit thereof. The present invention is therefore to be limited only by the scope of the following appended claims.

I claim:

1. A material for forming a lump at an end of a lashing string comprising:

a strap formed of a plastic material, said strap being rolled up, said strap having a first longitudinal side and a second longitudinal side, each of said first and second longitudinal sides having a plurality of ridges and a plurality of grooves arranged alternately therealong, one of said plurality of ridges and a portion of one of said plurality of grooves on each of said first and second longitudinal sides defining a lashing means which is separable from a remainder of said strap, said lashing means for attaching around the lashing string so as to form the lump.

2. The material of claim 1, said lashing means having an adhesive affixed to a surface thereof, said lashing, means for adhesively attaching around the lashing string.

3. The material of claim 1, said lashing means for forming into a separable tubular configuration around the lashing string.

* * * * *